United States Patent [19]

Doerfer et al.

[11] Patent Number: 4,893,578

[45] Date of Patent: Jan. 16, 1990

[54] COMBINATION LEANING BAR AND SUPPORT STRUCTURE FOR A BOAT SEAT

[75] Inventors: Richard E. Doerfer, Cape Coral; William B. Nesbitt, Fort Lauderdale, both of Fla.

[73] Assignee: Aquasport Marine Industries, Inc., Hialeah, Fla.

[21] Appl. No.: 235,012

[22] Filed: Aug. 22, 1988

[51] Int. Cl.[4] ..... B63B 17/00

[52] U.S. Cl. ..... 114/363; 297/94; 297/192

[58] Field of Search ..... 114/363; 297/72, 94, 297/192, 101; 403/84, 95, 96, 93

[56] References Cited

U.S. PATENT DOCUMENTS 450,672 4/1981 Johnston ..... 297/101

2,786,694 3/1957 Gray ..... 403/93 X

OTHER PUBLICATIONS

Fab Tech of Southwest Florida, Inc.—"Seat Frames by Fab Tech" brochure with photograph attached.

*Primary Examiner*—Sherman D. Basinger

*Attorney, Agent, or Firm*—Richard M. Saccocio

[57] ABSTRACT

The combination leaning bar assembly and support structure for a seat of a boat is disclosed. A leaning bar assembly is pivotally attached to a lower frame assembly which is used to house a bench type of seat comprising a food cooler therewithin. The rotatable locking device attached to the frame of the support structure for the seat allows the leaning bar to be moved from a forward position to an aft position into an intermediate position therebetween and to lock the same in any one of said positions.

8 Claims, 2 Drawing Sheets

COMBINATION LEANING BAR AND SUPPORT STRUCTURE FOR A BOAT SEAT

BACKGROUND OF THE INVENTION

1. Field of the Invention

This invention pertains in general to the field of apparatus for marine vessels and in particular to a combination leaning bar and support structure for a boat seat.

2. Description of the Prior Art

In medium sized boats, for example between seventeen and twenty-eight feet in length and particularly with sport fishing boats, the seating provided for the boat's captain may comprise a relatively rudimentary bench with a cushion thereon. A back support may or may not be included with the bench type of seat. Such bench type of seats are most often associated with boats having a center console and otherwise known as an open sports fishing boat. With such boats, seating comfort is not necessarily a prime consideration for boat seats. On the other hand, functionalism is a primary consideration.

In the recent past a new type of boat seating arrangement has been devised which comprises a plastic ice chest or cooler which is fitted with a cushion on the top thereof. This type of seating arrangement is even more functional than the older bench type of seat in that the new version allows for both seating and the storage of cooled food and drinks.

In order to secure the combination cooler and seating arrangement to the boat so that it is relatively secure during heavy seas in the prior art it has been the practice to utilize a sheet metal frame which is fastened to the boat deck and within which the cooler fits. The main advantage and object of such a structure is that the cooler may be removed from the sheet metal frame when the boat is not in use and is securely maintained in place when in use on the boat.

Also in the prior art a leaning post or bar which is sometimes called a rocket launcher is utilized in conjunction with the combination cooler and seating arrangement. The leaning bar typically comprised an inverted U-shaped frame member which is attached at its lower ends to the sheet metal frame and which includes an elongated pad extending across the horizontal length thereof. Such leaning bars are used by boat captains who prefer at times to stand while piloting the boat but yet have something to lean against so as to partially support their body weight. Typically, the prior art leaning bars were capable of pivoting at their support ends and being positionable in either a fore or aft angled position or in a central vertical position.

While the above-described prior art combination leaning bar and seat frame does function as such there are certain disadvantages associated with the same. One disadvantage is that an intermediate position of the leaning bar between the fore and aft position is lockable by use of a separate pin.

Accordingly, a primary object of the present invention is to provide leaning bar apparatus having a fore and an aft position with at least one intermediate position therebetween and lockable in any of said positions without the use of support pins.

Another object of the present invention is to provide leaning bar apparatus in combination with a support structure for a cooler which is functionable as a boat seat.

Another object of the present invention is to provide a support structure for the cooler functionable as a boat seat which does not utilize a sheet metal frame but rather uses a tubular steel frame.

SUMMARY OF THE INVENTION

The present invention overcomes the disadvantages of the prior art by providing a combination leaning bar assembly and support structure for a boat seat. The boat seat intended to be utilized with the present invention comprises a plastic cooler having a cushioned top which fits within the framework of the present invention and is contained therein in secure manner.

A U-shaped tubular assembly having an elongated padded bar attached thereto is pivotally connected at its lower ends to the support structure used to contain the cooler seat therein. The support structure for the seat comprises fore and aft frame members which are joined together with an offset bar member at each side thereof so as to form a rectangular shaped frame member having side openings. The side openings provide for the physical location and retention of the leaning bar assembly therewithin in any one of the positions attainable by the leaning bar assembly. A unique locking device comprising a rotatable sleeve is rotationally attached to each of the side bar members and may be moved from a substantially vertical to a substantially horizontal position which allows for moving of the leaning bar assembly forward and aft and locking the same in any one of its attainable positions.

Various other objects, advantages, and features of the invention will become apparent to those skilled in the art from the following discussion taken in conjunction with the following drawings, in which:

DESCRIPTION OF THE PREFERRED EMBODIMENTS

Figure 1:
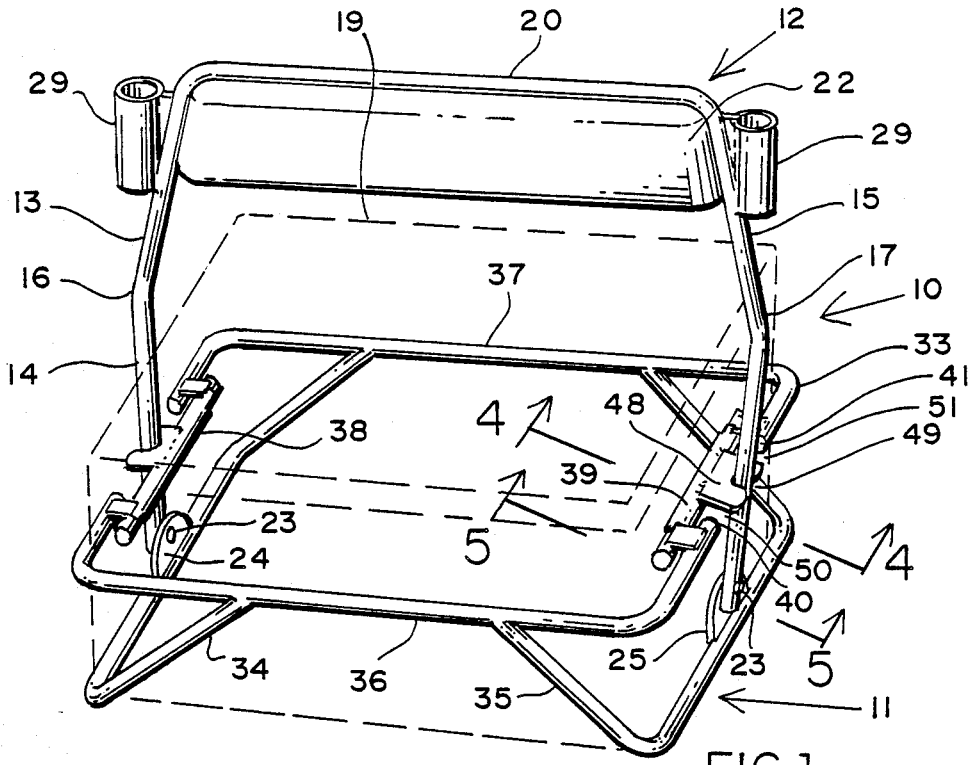
FIG. 1 is an isometric illustration of the inventive combination leaning bar and support structure for a boat seat.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings wherein like characteristics and features of the present invention shown in the various Figures are designated by the same reference numerals.

Figure 2:
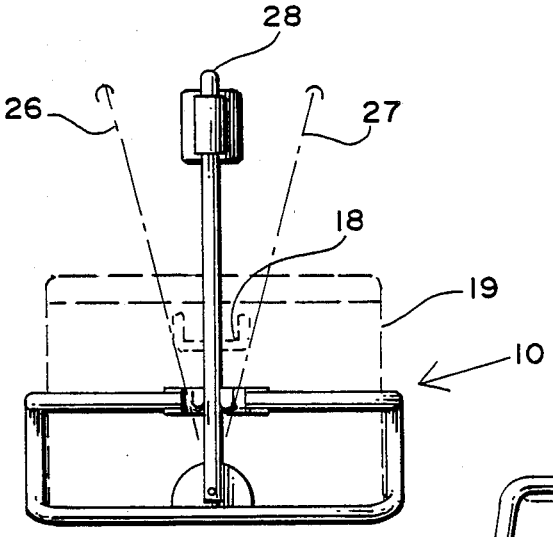
FIG. 2 is a side view of the embodiment of FIG. 1.
Figure 3:
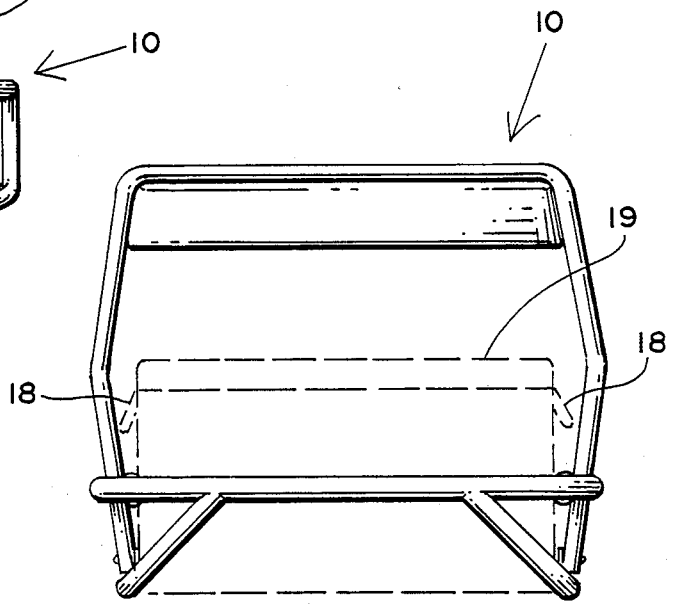
FIG. 3 is a front view of the embodiment of FIG. 1.

Reference is now made to FIGS. 1, 2 and 3 of the drawings which together show the overall shape and features of the inventive combination leaning bar and support structure for a boat seat which is generally designated by the reference numeral 10. The seat support structure comprising the lower box spring like member of the inventive assembly, is generally designated by the numeral 11; while, the leaning bar assembly comprising the inverted U-shaped member is generally designated by the numeral 12. The operative relationship between the seat frame structure 11 and the leaning bar structure 12 is unique and is an important feature of the present invention.

The leaning bar structure 12 comprises tubular member 13 formed in an inverted U-like shape having two sides 14 and 15 and a top portion 20 which of course are integrally connected to each other being that they are formed from a single piece of tubing. Since the apparatus described herein is to be utilized for boats and may, therefore, be subject to an extremely corrosive salt water environment, the material used for member 13 is stainless steel. Side members 14 and 15 include a slight bend 16 and 17 respectively at approximately the mid-length thereof. Bends 16, 17 are provided to allow side members 14 and 15 to clear the handles 18 on each side of the cooler 19 which may be utilized with the inventive apparatus. Cooler 19 of course serves to function as a storage receptacle for food, beverages and the like as well as the benched seat structure.

Leaning post 12 further includes an elongated cushion member 22 which is fitted between the upper portion of side members 14 and 15 and immediately below top portion 20. As shown more clearly in FIG. 2 cushion 22 extends beyond the thickness of side members 14 and 15 and top member 20. This extending thickness allows a person to lean against the cushion 22 and not necessarily be in contact with the tubular support frame 13 extending therearound. Since leaning bar assembly 12 is to be utilized for its leaning against function from both sides thereof, cushion 22 extends beyond tube member 13 both fore and aft thereof. Cushion member 22 may be secured to side members 14 and 15 by any conventional means such as screws or rivets.

The lower open ends of side members 14 and 15 are pivotally attached 23 to support plates 24 and 25 which are respectively attached to the lower support structure 11. As will be more fully explained hereinafter, leaning bar 12 is capable of being positioned in a fore position 26, aft position 27, and an intermediate upright position 28 (see FIG. 2).

Leaning bar assembly 12 may be equipped with a plurality of cylindrical containers 29 having an open upper end and a closed lower end which serve as holders for the butt end of fishing rods. Such containers 29 in combination with the leaning bar structure 12 are commonly referred to in the sport fishing industry as "rocket launchers". Such devices conveniently provide ready and quick access to the fishing rods contained within containers 29 without leaving the steering wheel of the boat.

The lower portion 11 of the inventive apparatus comprises a support structure for the cooler 19 which is fitted therewithin. Since a boat can experience relatively high impact loads during heavy seas seat support structure 11 must be firmly anchored to the boat and must be sufficiently strong so as to resist breakage during heavy seas when the cooler therewithin 19 is banging sideways and forward and backwards against the support structure 11. Again the material from which the support structure 11 is made consist of tubular stainless steel so as to withstand a severely corrosive salt water environment.

Figure 5:
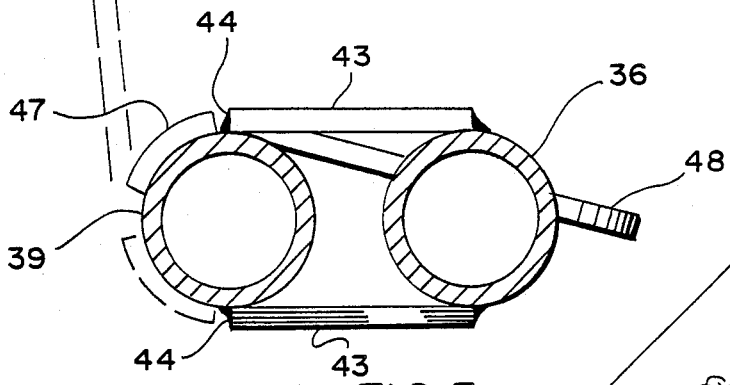
FIG. 5 is a cross-sectional view taken along the line 5—5 of FIG. 1.

The seat support structure comprises a generally rectangularly shaped containing frame 33 having a pair of legs 34 and 35 extending at an angle downwardly and outwardly therefrom. The containing frame portion 33 includes front and rear U-shaped members 36 and 37 respectively which are joined together by a pair of side bars 38 and 39 respectively. Side bars 38 and 39 are joined to front and rear members 36 and 37 such that an offset opening is created between the ends of front and rear members 36 and 37. The openings between the ends of the front and rear members 36 and 37, on the side thereof provides a physical location for the presence of the side members 14 and 15 of leaning bar 12. Furthermore, the opening between the ends of front and rear members 36 and 37 is such that it allows for and yet limits the pivoting movement of leaning bar 12 as illustrated in FIG. 2 of the drawings. The physical ends 40 and 41 provide a stop location for the forward and aft pivoting positions of leaning bar assembly 12. Side bar members 38 and 39 are connected to front and rear members 36 and 37 by small plates 43 welded therebetween. The length of plates 43 determines the width of the offset space between the front and rear members 36 and 37. FIGS. 1 and 5 illustrate plates 43 which are used to join side members to the front and rear members as well as illustrate the spacing therebetween. The inner ends 44 of plate members 43 serve as stops for the rotating motion of sleeve member 45 as will be more fully explained hereinafter.

Figure 6:
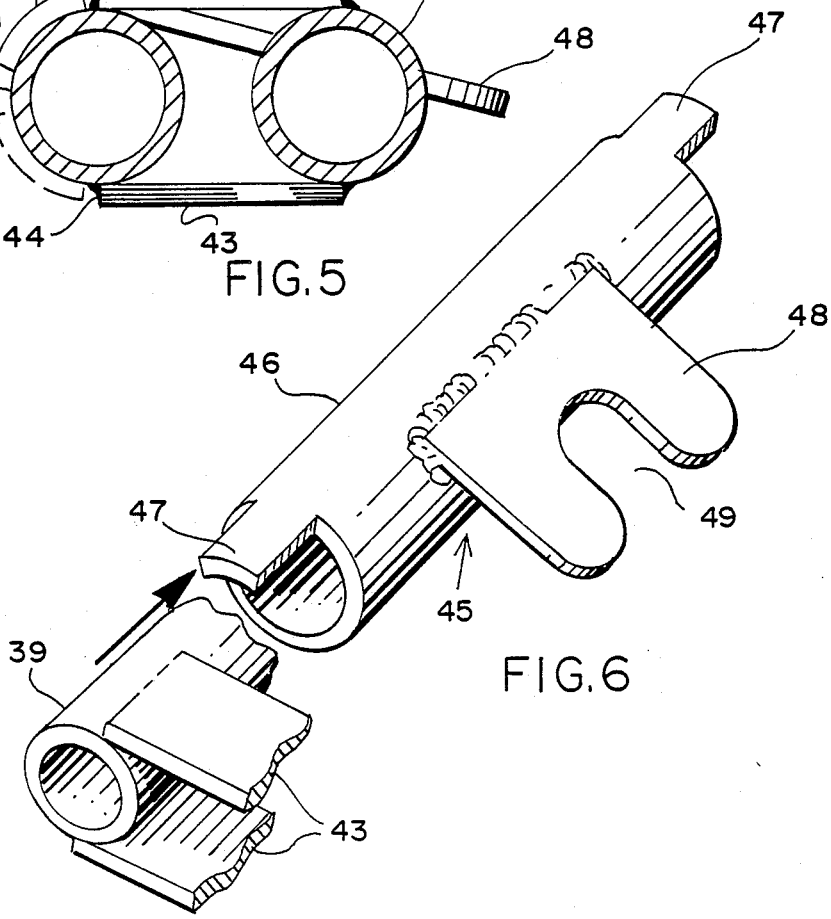
FIG. 6 is an isometric illustration of the locking member utilized with the invention for securing the leaning bar in a predetermined position.

Each side bar member 38 and 39 is provided with a sleeve member 45. Sleeve member 45 is shown isometrically in FIG. 6 of the drawings. Sleeve member 45 comprises a tubular portion 46 having tabs 47 extending from each end thereof. Tabs 47 may be an integral portion of sleeve member 46 which remains when the surrounding circumference is cut away therefrom. Hence, tabs 47 in cross-section have the same radius of curvature as sleeve member 46. Sleeve member 45 is fitted over side bar members 38 and 39 before they are welded to front and rear members 36 and 37 by plates 43. It is to be noted that plates 43 are welded to side members 38 and 39 and not sleeves 46. In this manner, sleeves 46 are free to rotate about side bar members 38 and 39.

The spacer member 48 comprising a plate having a cutout 49 therethrough is welded along the length of sleeve members 46. The width of cutout 49 and the spacers 50 and 51 defined by tubular ends 40 and 41 and the side edges of plate 49 are also sized to fit therewithin the tubular side portions 14, 15 of leaning bar 12. Accordingly, spacers 50, 49, 51 comprise locking detents for securing leaning bar assembly 12 in the forward 26, intermediate 28, and aft 27 positions of leaning bar assembly 12.

Figure 4:
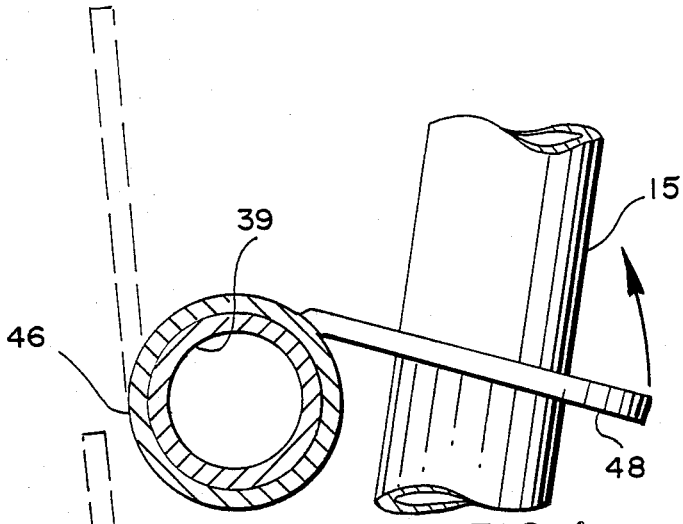
FIG. 4 is a cross-sectional view taken along the line 4—4 of FIG. 1.

Leaning bar assembly 12 may be moved from any one position to another position by simply rotating sleeve member 45 from for example the horizontal position shown in FIG. 4 to the vertical position shown in phantom therein. With the physical stop detents removed, the leaning bar assembly 12 may be moved to one of its different positions. Then, sleeve member 45 is again rotated from the vertical position to the substantially horizontal position shown in FIG. 4. As shown in FIG. 5, the edges of tabs 47 by contacting the edges of plates 43 limit the vertical and horizontal movement of sleeve 45. It is to be noted that plate member 48 extends slightly below the truly horizontal position and slightly beyond a truly vertical position as shown in FIG. 4 and 5 of the drawings. These over center positions of plate member 48 prevent sleeve member from rotating downwardly while leaning bar assembly 12 is being moved from one position to another as well as locks leaning bar member in position when in one of the positions shown in FIG. 2. Furthermore, a simple and positive locking means provided by sleeve member 45 accomplishes the same without the need for springs or other like apparatus which would be subject to failure and binding do in part to the corrosive environment of the salt water.

Leg members 34 and 35 each comprise a U-shaped tubular member which is welded to the lower side of front and rear members 36 and 37 respectively. The angular orientation of the vertical members of leg members 34 and 35 eliminate the need for an extra bend and provide cross braces which prevent the cooler 19 from tilting out from within the seat support structure 11 during rolling of the boat during heavy seas.

In accordance with the above there is described and illustrated the unique combination leaning bar and support structure for a boat seat.

Although particular embodiments of the invention have been shown and described in full here, there is no intention to thereby limit the invention to the details of such embodiments. On the contrary, the intention is to cover all modifications, alternatives, embodiments, usages and equivalents as fall within the spirit and scope of the present invention, specification and appended claims.

We claim as our invention:

1. Combination leaning bar apparatus and support structure apparatus for a boat seat comprising a boat seat support structure comprising a substantially rectangularly shaped tubular frame with legs attached thereto and extending downward therefrom, said substantially rectangularly shaped tubular frame comprising a forward U-shaped member, an aft U-shaped member arranged in a plane with a space between the ends of the U-shaped members, a side bar attached to adjacent ends of said U-shaped members and offset so as to maintain the space between the ends of the U-shaped members, a leaning bar assembly pivotally attached to said boat seat support structure, said leaning bar assembly having vertical side members respectively fitting within said spaces, locking means for locking said leaning bar assembly in a forward position, an aft position and an intermediate position therebetween.

2. The apparatus of claim 1, wherein said locking means is rotatable between a substantially vertical position and a substantially horizontal position wherein the force of gravity maintains said positions.

3. The apparatus of claim 2, wherein said substantially horizontal position of said locking means is angled slightly below horizontal.

4. The apparatus of claim 2, wherein said substantially vertical position of said locking means is angled slightly beyond vertical.

5. The apparatus of claim 1, wherein said legs comprise a pair of U-shaped members attached at an angle to and downwardly extending from said substantially rectangularly shaped tubular frame.

6. Combination leaning bar apparatus and support structure apparatus for a boat seat comprising a boat seat support structure comprising a substantially rectangularly shaped tubular frame with legs attached thereto and extending downward therefrom, said substantially rectangularly shaped tubular frame comprising a forward U-shaped member, an aft U-shaped member arranged in a plane with a space between the ends of the U-shaped members, a side bar attached to adjacent ends of said U-shaped members and offset so as to maintain the space between the ends of the U-shaped members, a leaning bar assembly pivotally attached to said boat seat support structure, said leaning bar assembly having vertical side members respectively fitting within said spaces, locking means for locking said leaning bar assembly in a position in accordance with its location with respect to said boat seat support structure.

7. The apparatus of claim 1 or 6, wherein said locking means comprises a sleeve member rotationally attached to each of said side bars, said sleeve member having a plate attached thereto, the side edges thereof forming detents defined further by the side bar and one end of said U-shaped members, said vertical side members of said leaning bar assembly each fitting within one of said detents.

8. The apparatus of claim 7, wherein said plate attached to said sleeve member includes an open sided opening forming an additional detent for fitting a leg of said leaning bar assembly.

* * * * *